United States Patent [19]

Gupta et al.

[11] 4,094,061

[45] June 13, 1978

[54] METHOD OF PRODUCING HOMOGENEOUS SINTERED ZNO NON-LINEAR RESISTORS

[75] Inventors: Tapan K. Gupta, Monroeville; William D. Straub, Penn Hills Township, Allegheny County, both of Pa.

[73] Assignee: Westinghouse Electric Corp., Pittsburgh, Pa.

[21] Appl. No.: 631,297

[22] Filed: Nov. 12, 1975

[51] Int. Cl.[2] ..... H01C 7/02

[52] U.S. Cl. ..... 29/612; 264/6; 264/61; 264/66

[58] Field of Search ..... 264/56, 66, 63, 61, 264/13; 252/518 A; 29/612

[56] References Cited

U.S. PATENT DOCUMENTS

| | | | |
|---|---|---|---|
| 3,549,736 | 12/1970 | Waugh | 264/63 |
| 3,663,458 | 5/1972 | Matsuoka et al. | 252/518 A |
| 3,689,863 | 9/1972 | Matsuoka et al. | 252/518 A |
| 3,903,226 | 9/1975 | Iga et al. | 264/66 |
| 3,953,371 | 4/1976 | May | 252/518 A |

OTHER PUBLICATIONS

Kingery, *Ceramic Fabrication Processes*, pp. 64–70, 1958.

*Primary Examiner*—Robert F. White
*Assistant Examiner*—John A. Parrish
*Attorney, Agent, or Firm*—D. P. Cillo

[57] ABSTRACT

A method of making a homogeneous ZnO sintered resistor body, having a substantially uniform density, which can exhibit non-linear V-I characteristics by a bulk effect, comprises the steps of: (1) mixing about 75 mole % to about 98 mole % of small, finely divided, solid ZnO and about 2 mole % to about 25 mole % of at least one small, finely divided, solid additive effective to produce non-linear characteristics within the body, preferably one or more oxides selected from the group consisting of $TiO_2$, $Ta_2O_5$, FeO, $In_2O_3$, $B_2O_3$, $Al_2O_3$, $SnO_2$, $Sn_3O_4$, $Mo_2O$, $SiO_2$, BaO, SrO, PbO, NiO, CaO, MgO, $Bi_2O_3$, $Co_3O_4$, CoO, MnO, $MnO_2$, $Cr_2O_3$, and $Sb_2O_3$, with an aqueous binder solution comprising a fugitive organic, water soluble binder, wherein the weight ratio of the aforesaid mixed finely divided solids:binder is between about 100:1 to about 100:10, to provide a slurry; (2) simultaneously drying, mixing and agglomerating the slurried solids into a mass of larger substantially spherical particles containing the finely divided solids and binder; (3) pressing a mass of the agglomerated particles or powder in a uni-axial press, to provide a cohesive pressed green body having a substantially uniform density; and then (4) heating the pressed body, first at a temperature rate increase effective to slowly decompose and remove the fugitive binder from the body and then heating at a temperature of between about 625° to about 1,400° C for a time effective to sinter together the particles of the body.

9 Claims, 2 Drawing Figures

METHOD OF PRODUCING HOMOGENEOUS SINTERED ZNO NON-LINEAR RESISTORS

BACKGROUND OF THE INVENTION

Unwanted voltage surges have long been a critical problem to circuit designers of industrial and home electrical systems. Surges generated by load switching are often repetitive and range as high as 2,500 V. Lightning generated surges can range up to or over 6,000 V.

Surge protective devices have been made from SiC. It is also known that ZnO when mixed with certain additives and sintered into pellets, can exhibit non-linear V-I characteristics superior to SiC. These modified ZnO compositions are, therefore candidate materials for non-linear lightning arrester components and non-linear resistor applications. Such devices can have non-linearity due to contact between the individual grains of SiC or ZnO, i.e., completely due to electrical phenomenon within the bulk of the body.

The ZnO non-linear devices have been made by mixing additive oxides with ZnO powder, and then pressing and sintering, as taught by Matsuoka et al, in U.S. Pat. No. 3,663,458. In that patent, ZnO is mixed in a wet mill for 5 hours with additive materials such as $Bi_2O_3$, $Sb_2O_3$, CoO and MnO to produce a homogeneous mixture. A binder such as water or polyvinyl alcohol can be added. The mixture was then molded at about 340 kg./sq. cm. (4,800 psi.) and single step sintered at 1,000° to 1,450° C for 1 to 3 hours, providing 1.3 cm. dia. by 0.05 to 0.25 cm. thick discs. Matsuoka et al, in U.S. Pat. No. 3,838,378, more thoroughly mixed ZnO in a wet mill for 24 hours with additive oxides and $CeF_3$, to produce an extremely homogeneous mixture to which a binder could be added. The mixture was then molded at 250 kg./sq. cm. (3,500 psi) and single step sintered at 1,000° to 1,450° C for 1 to 10 hours, to provide bulk voltage non-linear bodies for lightning arresters, with dimensions as large as 3.5 to 4 cm. dia. and 2 cm. thickness.

Mixing the materials is one of the most important operations in making non-linear lightning arrester components and non-linear resistors, because the physical homogeneity of the product, and the reproducibility of the electrical characteristics, will depend on thorough mixing of the component powders. We have found that by merely milling or blend-mixing the ingredients, only a marginally acceptable product is produced, resulting in a large percentage of lightning arrester components and resistors being rejected due to varying electrical properties caused by lack of homogeneity. Also, most blend-mixed ZnO compositions require pressures of about 250 kg./sq. cm. to 2,140 kg./sq. cm. (3,500 psi. to 30,000 psi.) to consolidate the composition prior to sintering. These blend-mixed compositions appear to require high pressures and/or the use of expensive isostatic presses, to lessen the dramatic density gradient through the pressed body that otherwise exists after standard single or double action non-isostatic, uni-axial type pressing.

Organic binders, such as polyvinyl alcohol, have been used in the ceramic industry as an aid to granulation of ceramic oxide particles. Teter, in "Evaluation of Binders For Machinable Unfired Ceramics" RFP 659, Distributed by Clearing House For Federal Scientific And Technical Information, U.S. Dept. of Commerce Institute For Applied Tech., Dec. 10, 1965, described tensile strength testing of large ceramic bars made using $Al_2O_3$, MgO or ZnO ceramic oxides with polyvinyl alcohol as a binder and using spray drying techniques. After wet milling the oxide-binder, the slurry was fed into a spray drying apparatus to provide granulated powder having an average particle size of 15 microns. The bars measured 1.9 cm. by 1.9 cm. by 15 cm., but Teter used isostatic pressing at 20,000 psi. to get a uniform compact. Waxes were then added to increase mechanical strength for machining.

It should be apparent that a method of producing ZnO sintered bodies, useful as surge protective devices such as voltage-non-linear resistors which are useful as lightning arrester components, and other type voltage limiters, using relatively low consolidation pressures, so that inexpensive graphite or steel dies can be used, and yet providing a uniform density gradient through the pressed body would be an advantageous advance in the art.

The method should be capable of producing larger type sintered bodies, having diameters of at least 2 in. (5 cm.) and a thickness of at least ¼ in. (0.64 cm.), so as to be useful as stacked voltage non-linear components in lightning arresters. Preferably, bodies would be about 4 inches in diameter and 3 inches in thickness. Such thickness would allow the bodies to be cut to size for lightning arrester component applications, dramatically cutting down on the time-consuming pressing and sintering operations.

SUMMARY OF THE INVENTION

In the method of this invention, a combination of zinc oxide particles and the modifying particles (preferably certain other oxides), binder, and preferably lubricant are mixed and agglomerated to form powder agglomerates within a particular particle size range, pressed and sintered, to provide a homogeneous surge protective body of substantially uniform density. Such a surge protective body has non-ohmic resistance due to a bulk electrical effect. The combination of oxides, binder and mix-agglomeration processing allows low pressure consolidation, i.e., between about 72 kg./sq. cm. to about 240 kg./sq. cm. (1,000 psi. to 3,350 psi.), an improved, pressed "green" body, and a substantial reduction in the density gradient through the body.

The method of making the ZnO body comprises the steps of: (1) mixing about 75 mole % to about 98 mole % of ZnO powder particles with about 2 mole % to about 25 mole % of suitable modifying additive compound powder particles known to be effective to produce non-linear electrical characteristics completely within the body, such as, preferably $TiO_2$, $Ta_2O_5$, FeO, $In_2O_3$, $B_2O_3$, $Al_2O_3$, $SnO_2$, $Sn_3O_4$, $Mo_2O$, $SiO_2$, BaO, SrO, PbO, NiO, CaO, MgO and $CeF_3$, and most preferably $Bi_2O_3$, $Co_3O_4$, CoO, MnO, $MnO_2$, $Cr_2O_3$ and $Sb_2O_3$, their equivalents and their mixtures; (2) adding the particle mixture to an aqueous binder solution comprising an organic, water soluble fugitive binder such as polyvinyl alcohol and an optional organic lubricating wax, preferably Carbowax, and mixtures thereof, to provide a slurry.

The weight ratio of mixed solid particles (ZnO and additive compounds):binder is preferably from about 100:1 to about 100:10. The weight ratio of mixed solid particles: lubricant, when used, is preferably from about 100:0.1 to about 100:4; (3) feeding the slurry into a means to simultaneously dry, mix, and agglomerate the particles and binder, such as a freeze drying or preferably a spray drying-mixing apparatus. In both cases, as the result of this step, the particles are dried, agglomerated into larger smooth, substantially spherical shape, agglomerated powder masses, preferably having at least 50 wt.% of the agglomerates with a size between 25 to about 500 microns, and the fugitive binder is uniformly distributed through the oxide particles, which particles are ultra-homogeneously mixed; (4) pressing the powder at between about 36 kg./sq. cm. to about 1,500 kg./sq. cm. (500 psi. to 21,000 psi.) but preferably at between about 72 kg./sq. cm. to about 240 kg./sq. cm. (1,000 psi. to 3,350 psi), to provide a consolidated body of substantially uniform density; (5) dual heating the pressed body to form a sintered pellet, first at a temperature rate increase effective to slowly decompose and burn off the binder and optional lubricant, and as a second step at a temperature of between about 625° to about 1,400° C for a time effective to sinter the powder body.

BRIEF DESCRIPTION OF THE DRAWING

For a better understanding of the invention, reference may be made to the preferred embodiment, exemplary of the invention, shown in the accompanying drawings, in which.

DESCRIPTION OF THE PREFERRED EMBODIMENTS

Figure 1:
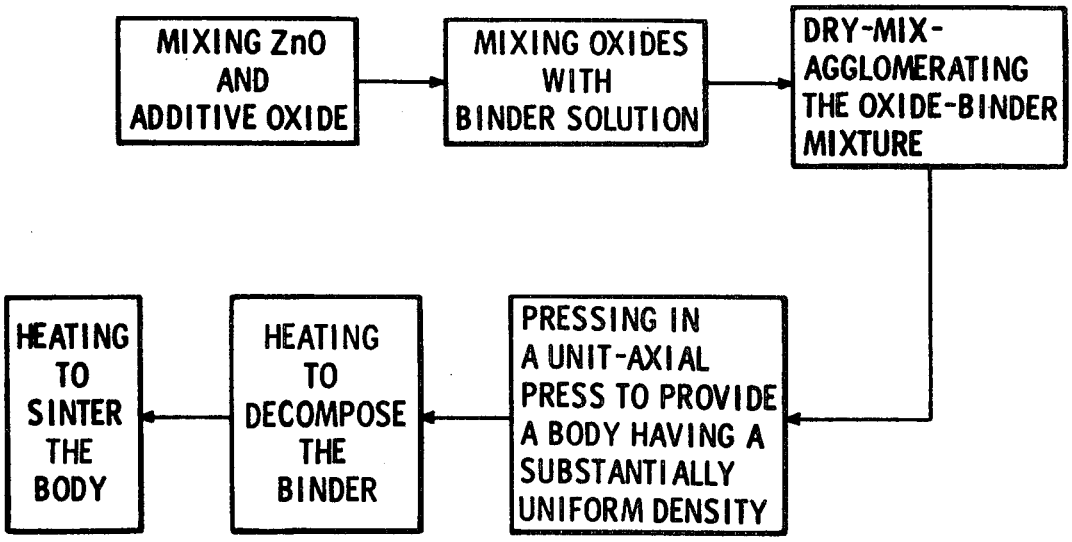
FIG. 1 is a flow diagram of the preferred method of this invention.

According to the invention, there is provided a homogeneous sintered body, useful as voltage-non-linear resistors, comprising a major portion of from about 75 mole % to 98 mole %, preferably about 92 mole % to about 96 mole % of ZnO powder particles, and an effective minor amount of any particulate additive compound that will cause electrical non-linearity completely within the bulk of the body, generally between about 2 mole % to 25 mole %. The additive compound powder is preferably selected from $TiO_2$, $Ta_2O_5$, FeO, $In_2O_3$, $B_2O_3$, $Al_2O_3$, $SnO_2$, $Sn_3O_4$, $Mo_2O$, $SiO_2$, BaO, SrO, PbO, NiO, CaO, MgO and $CeF_3$, and most preferably $Bi_2O_3$, $Co_3O_4$, CoO, MnO, $MnO_2$, $Cr_2O_3$ and $Sb_2O_3$ and their equivalents and their mixtures.

The ZnO and modifying additive are mixed, in the proportions set forth above, as a first step to form a mixed oxide powder. The ZnO, and preferably, also the oxide additive, will have a preferred average particle size of between about 0.01 micron to about 1.5 microns irregular diameter — i.e., the diameter of a circle that can be circumscribed around a particle if it has an irregular or rectangular shape.

This oxide mixture is then added to a blended binder solution comprising an aqueous solution of: (1) an organic, water soluble, liquid or solid fugitive binder such as, for example, polyvinyl alcohol, glycerin, triethanol amine, methyl cellulose, and hydroxy ethyl cellulose, with polyvinyl alcohol having a molecular weight of between about 10,000 to 25,000 preferred, and optionally, (2) an organic fugitive lubricating wax, such as, for example, Beeswax, Carnauba wax, paraffin wax and preferably Carbowax, a solid waxy polyethylene glycol, and mixtures thereof. This provides a mixed oxide binder slurry which may include wax at this point.

Usually, the solid mixed oxides (ZnO and additive oxides) will comprise about 10 wt.% to about 50 wt.% of the slurry. The weight ratio of mixed oxides:binder is preferably from about 100:1 to about 100:10. Less than 1 part binder per 100 parts mixed oxides will not provide sufficient "green strength" after subsequent low pressure pressing, for the material to be easily handled. This minimal amount of binder is critical in allowing the formation of large spherical agglomerates, which provide good flow, shear, and compaction properties, and allows low consolidation pressure and use of inexpensive dies. It is also critical in providing a minimum density gradient through the consolidated body even after low pressure single or double action uni-axial pressing.

Over 10 parts binder per 100 parts of mixed oxides will complicate the subsequent dual sintering step, because it will be very difficult to burn off all of the fugitive binder before completely sintering the molded body.

Ordinarily, standard single or double action uniaxial pressing of non-spray dried, wet milled or blend-mixed, ZnO + additive oxide powder results in density variation of from about 55% of the theoretical density of the single phase pure ZnO at the end of the body, where press plungers make contact, to about 35% to 40% in the middle of the body. This large density gradient through the pressed body adds to the probability of varying bulk density and electrical properties in the final product. The density gradient can be measured from sample slices through various portions of the body.

In the method of this invention, utilizing a ZnO + additive oxide + binder composition, mix-agglomeration to provide specific sized agglomerated powder and double sintering, the density variation is only from about 55% of theoretical density at the end of the body, to about 45% in the middle of the body. This substantially uniform and reduced density gradient eliminates the need for isostatic or hydrostatic pressing, to attempt to lessen the gradient, in which the single or double action uni-axially pressed body is placed in a flexible evacuated container, and the container placed in a pressure transmitting fluid such as a water-oil mixture, which mixture is then subjected to equal pressure on all sides. Needless to say, elimination of this sophisticated extra pressing step makes the method of this invention extremely useful commercially.

While use of lubricating wax in the slurry is optional, it significantly improves flow and shear properties during pressing. The weight ratio of mixed solid particles: lubricant, when used, is preferably from about 100:0.1 to 100:4. Over 4 parts solid lubricant per 100 parts of mixed solid oxides will complicate the subsequent dual sintering step, because it will be very difficult to burn off all the lubricant before completely sintering the molded body.

In all cases, both the organic, water soluble, fugitive binder material and the organic, fugitive lubricant material must be capable of dispersing in water to form an emulsion, and must be able to completely decompose, evaporate, oxidate, or burn off the pressed body at temperatures below complete sintering of the mixed oxides, generally between about 150° to about 600° C, generally forming a gas and leaving no carbon residue harmful to the electrical properties of the final sintered body. Additionally, these materials should be able to withstand the average 200° C temperature found in spray drying without polymerizing. Equivalent materials in addition to those preferred materials listed above can be easily determined by those skilled in the art.

Both of these materials must have minimal interaction with the ions present in the mixed oxide powder, so that the slurry mixture does not gel prior to the mix-agglomerating step. The viscosity of the slurry mixture should not exceed about 3,000 cp. at 25° C, otherwise freeze or spray drying techniques may not be useful. Both of these materials must of course also be able to withstand the pumping and atomizing to which they may be subjected.

This aqueous admixture of ZnO, additive and binder is preferably wet mill grind mixed for about 1 hour to 12 hours, but usually only about 1 to 4 hours in a mill with cylindrical alumina media. This provides quick mixing and a marginally homogeneous mixture having a viscosity of about 50 cp. to about 3,000 cp. at 25° C. After wet mill mixing the aqueous admixture, it is preferably kept agitated, as by stirring, so that the solid particles do not settle.

The aqueous admixture is then fed into a spray or freeze dyring apparatus which is effective to remove water, cause agglomeration of the discrete solid oxide particles into larger smooth, substantially spherical shape, powder masses having average agglomerate sizes of between about 0.5 micron to about 500 microns diameter and uniformly distribute the binder. The drying, mixing and agglomerating may be considered to occur essentially simultaneously in such apparatus. As many as 1,000 slurry particles can combine, as the result of binder inclusion in the slurry, to form a single, smooth, round shape agglomerate. Better flow characteristics are achieved with larger agglomerates, and so at least 50 wt.% of the agglomerated particles should be wintin a 25 to 500 micron range.

Shrinkage during sintering is greater for powders having a distribution of particle sizes. Powders having an average particle size of 1 micron and 50 micron diametrically shrink about 21% to 22% during sintering, whereas powders containing about 50 wt.% each of 1 micron and 50 micron particles shrink about 23% to 27%, providing a more uniform density due to greater particle contact during sintering.

In order to achieve the most useful electrical and uniform density properties, the most preferred powder will contain 20 to 50 wt.% of the agglomerates between about 0.5 to about 2.5 microns and 50 to 80 wt.% of the agglomerates between about 25 to about 500 microns average particle size. This will provide a highly flowable, easily compacted power which has extremely advantageous densification properties during dual sintering.

Of the two examples of suitable water removing and mix-agglomerating or mix-granulation means (freeze drying apparatus and spray drying apparatus) the latter is preferred as more convenient and because of actual successful experience therewith. Generally, in a freeze drying apparatus, the slurry is pressure sprayed into a cold (−70° C) hexane bath. Water is removed from the solid spheres of particles and ice crystals by sublimation in a freeze dryer. The dried particles agglomerate and form spherical shape masses as a free flowing powder.

In spray drying, the slurry is atomized and pressure injected into a stream of hot air. If the slurry has a viscosity over about 3,000 cp. at 25° C, it will be difficult to atomize. Inlet temperatures, in the method of this invention, can be as high as about 390° C without decomposing the binder and optional lubricating wax, due to the presence of water. Outlet temperatures are generally about 110° C. The average temperature in the apparatus will be about 200° C. The atomized slurry forms spherical globules upon introduction into the chamber, the water evaporates and the solid spheres of particles agglomerate and form spherical shape masses as a free flowing powder of agglomerates. The waste gases are exhausted and the dried agglomerated masses may be cyclonically separated into different size fractions. If different fractions are collected, they may be subsequently blended for about 0.5 hour to 3 hours in, for example, a tumbling V-blender to insure homogeneity of the mixed powder.

Both spray dry-mixing and freeze dry-mixing are effective means to evaporate the water and uniformly distribute the oxide particles and the organic binder within agglomerate, smooth, spherical shape masses. Both types of apparatus are well known in the art and reference may be made to *Ceramic Bulletin,* Vol. 53, No. 3 (1974) at pp 232 to 233, No. 5 (1974) at pp 421 to pp 421 to 12 (1974) at pp 850 to 852 for their description.

The dry mix-agglomerated material is next poured as a free flowing powder into a suitable die. It is then pressed, using a uni-axial die and plunger type press, preferably at between about 72 kg./sq. cm. to about 240 kg./sq. cm. (1,000 psi. to 3,350 psi.), although pressures as low as about 36 kg./sq. cm. may be used. The use of the binder and a specific agglomerate size distribution provides the powder with good flow, shear and compaction properties, and addition of the optional lubricant improves thses properties.

The use of the binder, to allow large agglomerate masses comprising the powder, is primarily responsible for allowing low pressure pressing, and allowing the use of inexpensive graphite or steel dies, as a substitute for special carbine coated steel dies. The use of the binder provides a pressed body having sufficient "green strength" to be handled in a commercial processing operation prior to sintering. Of course, higher pressures, up to 1,500 kg./sq. cm., may be used.

The binder allows easy compaction of the powder, and provides a substantially uniform density, i.e., one that will vary no more than about 10% throughout the pressed body. Generally after pressing, the density at the pressed ends of the body will vary between about 50% to about 60% of the theoretical density of the single phase pure ZnO. If the density at the end of the body is 55%, then the density in the middle of the body will be between about 55% and 45%.

Finally, the pressed powder is subjected to an essential two-staged heating process. The pressed body is placed in a suitable oven or other heating means, first at a temperature that will not completely sinter the mixed oxides, generally between about 25° to about 600° C for a time effective to slowly decompose, burn off and eliminate all of the fugitive binder and optional fugitive lubricant, to leave no electrically conducting carbon residue. During this step some minor amount of sintering will occur but not enough to trap binder or optional lubricant within the body before the binder or lubricant are vaporized. This step will usually take about 10 hrs. to about 35 hrs. at a temperature rate increase of between about 10° C/hr. to about 45° C/hr. Rates faster than about 45° C/hr. may result in cracks throughout the finished body. Most useful binders and lubricants will burn off at between about 200° to about 400° C.

As a second step, the powder body is finally heated at a temperature and for a time effective to completely sinter the powder masses together to form a homogeneous ZnO sintered body, generally at a temperature of between about 625° to about 1,400° C, preferably between about 900° to about 1,200° C. In the second step, the pressed body is heated at a temperature rate increase of between about 75° C/hr. to about 150° C/hr.

The final product will generally shrink substantially and have a density at the ends of between about 85% to about 98% of the theoretical density of the single phase pure ZnO. The density will be substantially uniform throughout the mass, i.e., one that will vary no more than about 10%, and preferably no more than about 5%, throughout the pressed sintered body. If the density at the end of the body is 95%, then the density in the middle of the body will be between about 95% and 85%, but usually between about 95% to 92%. Using the method of this invention, sintered bodies having diameters over 2 in. and thicknesses over ¼ in. are easily fabricated and are particularly useful in lightning arresters.

Figure 2:
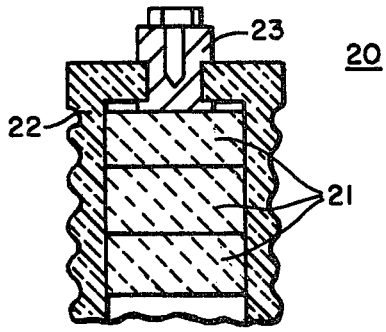
FIG. 2 is a cross-sectional view through a lightning arrester.

FIG. 1 shows the method of this invention as a flow diagram. FIG. 2 shows one embodiment of an arrester 20 comprising as a characteristic element, at least one voltage-nonlinear surge protective resistor body described in this invention as lightning arrester component 21, enveloped in a porcelain insulator 22 with associated line terminal 23. As a non-linear resistor, sintered bodies made in accordance with this invention can be lapped at opposite surfaces by abrasive powder and provided with electrodes applied by any suitable method such as silver painting or vacuum evaporation or flame spraying of a metal such as Al or Sn.

In the sintered body, the sintered polycrystalline ZnO grains will be coated and bound with the second phase oxide additives. These additive oxides are effective to produce electrical non-linearity completely within the bulk of the body. The voltage limiting characteristic of these surge protective materials is believed to be due to the character of the grain boundary within the bulk or body of the material, which is near-insulating at low voltage and conducting at a high voltage. Thus, on impressing a voltage, the resistance changes from a linear function of I (current) and V (voltage) - Ohm's Law, to a power function of $I \alpha V^{\alpha}$, where $\alpha$, the non-ohmic exponent, is a measure of non-linearity, and has a value greater than one. The final product of this invention will exhibit a high degree of non-linearity, $\alpha$ greater than 25, when subjected to a voltage surge. The voltage at the onset of non-linearity may be defined as the breakdown voltage (BOV).

EXAMPLE 1

A 100 gram ZnO composition was made by admixing 87.68 grams (95 mole %) of reagent grade ZnO, 5.62 grams (1 mole %) of reagent grade $Bi_2O_3$, 0.85 grams (1 mole %) of reagent grade CoO, 0.80 gram (1 mole %) of reagent grade MnO, 1.72 grams (1 mole %) of reagent grade $Cr_2O_3$ and 3.31 grams (1 mole %) of reagent grade $Sb_2O_3$. This provides a composition of 95 mole % ZnO and 5 mole % additive oxides. Both the ZnO and additive oxides had an average particle size of between about 0.05 micron to about 1.0 micron and were of irregular, generally rectangular block shape.

A binder solution was made by blending and dissolving 3 grams of solid, polyvinyl alcohol binder having a molecular weight of about 13,000 to 15,000 and 0.5 grams of a solid polyethylene glycol wax having a molecular weight of about 150 to 250 (sold commercially by Union Carbide under the trade name Carbowax) in 240 grams of water.

The ZnO + additive oxide composition was added to the binder solution to provide a mixed oxide binder lubricant slurry containing about 29 wt.% oxides. The weight ratio of mixed solid oxide particles:binder was 100:3 and the weight ratio of mixed solid oxide particles:lubricant was 100:0.5. The fugitive (to be eliminated) binder material had a decomposition temperature of between about 210° to about 250° C, and the fugitive lubricant had a decomposition temperature of between about 265° to about 305° C. The slurry was mixed for 2 hours in a ball mill with cylindrical alumina media. The resulting slurry did not gel, showed a fair amount of homogeneity, had a specific gravity of 1.34 and a viscosity of 360 cp. at 25° C using a Brookfield Spindle Viscometer. The slurry was emptied into a Nalgene (polyethylene) drum equipped with a stirrer and agitated continuously by stirring.

A Nichols Spray Dryer with a screw feed pump was first put into operation using water as the feed material for 2 hours to complete operating stabilization. The water was then cut off and the above described slurry pumped into the spray drier at a constant feed rate (dial setting 5-⅓) with an atomization pressure of about 3.8 kg./sq. cm. The burner temperature was 900° C, giving an inlet temperature of 390° C and an outlet temperature of 125° C.

In this spray drying step, the slurry is rapidly heated, the water evaporates, the oxides, binder and wax are ultra-homogeneously mixed, and the discrete irregular particles agglomerate and form large, smooth, spherical shape agglomerates in the form of free flowing powder. The free flowing powder was collected in two separate fractions — a cyclone fraction (about 43 wt.% of about 0.5 to 1.0 micron average diameter) and a chamber fraction (about 57 wt.% of about 50 to 60 micron average diameter). Thus, in the chamber fraction as many as 500 to 1000 particles can agglomerate to form a single spray-dried agglomerate of spherical shape.

The spray dried powder was examined under a 200X microscope and the spherical shape masses were observed in both fractions. The flow characteristic of each fraction was ascertained by observing the flow of the powder on the inner surface of a glass container while being slowly rotated. The larger sized chamber powder had superior flow characteristics.

Differential thermal analysis (DTA) at 10° C/min. in air and thermogravimetric (TGA) analysis were conducted on both fractions. They showed similar characteristics which indirectly demonstrated that the organic binder was uniformly distributed irrespective of the size of the spray-dried powder. The exact temperature at which burn off occurred was 230° C for the binder and 285° C for the wax. The DTA data are substantiated by weight loss data from the TGA tests, which shows that a major weight loss occurs between 200° and 400° C. The amount of weight loss is approximately 2.5% to 3%, in reasonable agreement with the amount of binder and wax added. Before using the powder, the two separate fractions were blended for 1 hour using a stainless steel tumbling V-blender to assure homogeneity of the mixed powder. This provided a powder with at least ½ of the agglomerates over 25 microns average diameter.

The mix agglomerated powder was poured into a regular steel die having about a 3.8 cm. (1-½ in.) diameter. In order to more easily determine BOV values, very thin cylindrical discs were fabricated by employing standard double action pressing (floating die) at 214 kg./sq. cm. (3,000 psi.). The agglomerated powder was sheared and fractured during compaction. No difficulties were encountered during pressing. The "green" cylindrical pressed body was easily removed from the die. It was strongly consolidated and easily handled, demonstrating excellent "green strength". It was about 55% dense and appeared to be extremely uniform in density through its thickness.

The pressed cylindrical disc was then placed in a Burrell electrically heated tube furnace with an open-ended rectangular cross-section high alumina tube incorporating a heating zone of about 15.24 cm. (6 in.) long. The pressed body was placed on 50 to 100 mesh zirconia in a zircon refractory boat. The furnace was raised from 25° to 288° C at a temperature rate increase of 24° C/hr. and held at that temperature for 14 hours to allow slow decomposition burnoff and removal of all of the fugitive binder and wax from the pressed disc. It is essential to burn off the binder and wax in the initial heating step. As a second heating step, the temperature was then raised rapidly to 1,100° C at a temperature rate increase of about 120° C/hr. and held at that temperature for 2 hours to allow complete sintering of the ceramic body.

After heat treatment, the sample was given a light surface grinding, weighed and its dimensions measured. The diameter was about 2.84 cm., and the height was about 0.58 cm., showing approximately 25% diametral shrinkage. The weight was 19 grams and the density was 5.2 grams/cu. cm. The sample was about 95% dense and appeared to be completely homogeneous and almost completely uniform in density through its thickness, with an apparent variation of approximately 5%. This provided an extremely uniformly dense voltage-nonlinear resistor useful for lightning arrester component application.

This pressed, thin, sintered disc was subjected to a D.C. electrical test to record the breakover voltage (BOV). The sample was placed between Cu electrodes and voltage applied from a D.C. power supply having a voltage capacity between 300 and 3,000 V. and a current rating of 25 ma. At the beginning, there was a slow rise of current indicating the ZnO body was acting as a near-insulator, but at a breakover voltage of 4.9 kv./cm. the current increased suddenly indicating the ZnO body was then acting as a conductor. The non-linear coefficient $\alpha$ was estimated to be about 25, making it particularly suitable for lightning arrester application. Similar values could be expected of larger samples.

With spray-dried powder as the starting material, there seems to be little limitation to the size of the sample. Also, since the powder can be easily pressed as low as 214 kg./sq. cm. with excellent uniformity, very inexpensive dies can be used for fabrication of the samples, as shown below.

Following the procedure outlined above, and using the same pressing pressure and spray-dried powder, a 7.7 cm. (3 in.) diameter 1.1 cm. (0.43 in.) thick disc of excellent homogeneity and uniformity was fabricated. In a similar fashion, using the same procedure and powder but a different die, a very wide 15.2 cm. (6 in.) diameter, 2.5 cm. (1 in.) thick disc of excellent homogeneity and uniformity was fabricated using an inexpensive graphite die, and employing standard double action uni-axial pressing (floating die), at only 72 kg./sq. cm. (1,000 psi).

In another pressing, following the same procedure as outlined above and using the same pressing pressure but substituting 1 mole % $Co_3O_4$ for CoO and 1 mole % $MnO_2$ for MnO, a 5.1 cm. (2 in.) diameter 10.2 cm. (4 in.) very thick disc of excellent homogeneity and uniformity was produced employing standard double action uni-axial pressing at 214 kg./sq. cm. (3,000 psi.). The body was about 93% dense with a variation of less than about 10% from end to end through the body. The ability to fabricate bodies of this thickness is especially important commercially as fewer time comsuming mix-agglomerating-press-sintering cycles are required to get equal numbers of lightning arrester components, since the thick discs can simply be cut to four or more thinner size discs.

The other additive oxides, binders and lubricating waxes, as well as use of freeze drying techniques to mix-agglomerate, would be equally suitable to provide the homogeneous, ZnO sintered body of this invention. The elimination of the lubricating wax will still provide a useful ZnO sintered body of substantially uniform density as long as the binder is used. Since the standard size for the stacked component discs used in a medium range lightning arrester is approximately 4 inches in diameter by 1-½ inches in thickness, this method is particularly useful for their low cost manufacture.

EXAMPLE 2

As a comparative example, a 100 gram ZnO composition was made from 95 mole % ZnO and 1 mole % each of $Bi_2O_3$, CoO, MnO, $Cr_2O_3$ and $Sb_2O_3$, as in EXAMPLE 1, but no binder or lubricating wax was added. This ZnO composition was then ball milled for 48 hours with alumina media. The resulting powder even with long wet milling did not have the free flow characteristics of the spray-dried powder of EXAMPLE 1.

Following the mechanical mixing, the ZnO composition was then placed into a double acting uni-axial press and pressed as in EXAMPLE 1. The disc did not have the "green strength," the homogeneity, or uniform density of the spray dried-mixed, pressed disc of EXAMPLE 1. In order to properly consolidate and reduce the density gradient of the powder, the disc required further pressing in an isostatic environment at a final pressure of about 2,140 kg./sq. cm. (30,000 psi.).

We claim:

1. A method of making a homogeneous, sintered, resistor body, having a substantially uniform density, which can exhibit nonlinear V-I characteristics, comprising the steps of:

(A) mixing:

(1) a solid particle composition admixture of 75 mole % to 98 mole % of small, finely divided ZnO and 2 mole % to 25 mole % of a small, finely divided additive compound effective to produce non-linearity characteristics within the body, with (2) an aqueous binder solution comprising an organic, water soluble binder that will decompose at temperatures of between about 150° to about 600° C leaving no carbon residue, wherein the weight ratio of solid particles:binder is between about 100:1 to about 100:10, to provide a mixed particle-binder slurry, and then (B) simultaneously drying, mixing and agglomerating the slurry to form a mass of larger spherical particles, the agglomerated particles having an average particle size of between about 0.5 micron to about 500 microns diameter, and at least 50 wt.% of the agglomerated particles have an average particle size between 25 microns to about 500 microns, said particles containing binder, ZnO and additive compound distributed therethrough, and then (C) pressing a mass of the agglomerated particles in a uni-axial press, at between about 36 kg./sq. cm. to about 1,500 kg./sq. cm., to provide a body having a substantially uniform density, and then (D) heating the pressed body:

(1) first at a temperature of between 25° and about 600° C, at a temperature rate increase of between 10° C/hr. to about 45° C/hr., effective to slowly decompose and remove the binder, and then (2) between about 625° to about 1,400° C, at a temperature rate increase of between about 75° C/hr. to about 150° C/hr., for a time effective to sinter together the particles of the pressed body, thereby forming a homogeneous sintered body having a substantially uniform density, exhibiting non-linear V-I characteristics.

2. The method of claim 1 wherein the aqueous binder solution also contains an organic lubricating wax that will decompose at temperatures of between about 150° to about 600° C, wherein the weight ratio of mixed particles: lubricant is between about 100:0.1 to about 100:4.

3. The method of claim 1 wherein the additive compound is an oxide selected from the group consisting of $TiO_2$, $Ta_2O_5$, FeO, $In_2O_3$, $B_2O_3$, $Al_2O_3$, $SnO_2$, $Sn_3O_4$, $Mo_2O$, $SiO_2$, $B_2O$, SrO, PbO, NiO, CaO, MgO, $Bi_2O_3$, $Co_3O_4$, CoO, MnO, $MnO_2$, $Cr_2O_3$ and $Sb_2O_3$ and mixtures thereof.

4. The method of claim 3 wherein the density of the pressed body and sintered pressed body will vary no more than about 10% between the ends of the oxide additive is selected from the group consisting of $Bi_2O_3$, $Co_3O_4$, CoO, MnO, $MnO_2$, $Cr_2O_3$, $Sb_2O_3$ and mixtures thereof, the binder is polyvinyl alcohol, and 50 wt.% to 80 wt.% of the agglomerated power masses have an average particle size of between about 25 microns and about 500 microns, and 20 wt.% to 50 wt.% of the agglomerated power particles have an average particle size of between about 0.5 micron and about 2.5 microns mixed in step (A)(1).

5. The method of claim 3 wherein the oxides have an average particle size of between about 0.01 micron to about 1.5 micron diameter and in step (A) the ZnO and additive are mixed by wet milling.

6. The method of claim 3 wherein spray-drying is used to simultaneously dry, mix, and agglomerate, and a pressure of between about 72 kg./sq. cm. to about 240 kg./sq. cm. is used in the pressing step.

7. A method of making a homogeneous sintered, resistor body, having a substantially uniform density, which can exhibit non-linear V-I characteristics due to bulk electrical effects within the body, by:

(A) wet mill mixing:

(1) a solid particle composition admixture of 75 mole % to 98 mole % of ZnO having an average particle size of between about 0.01 micron to about 1.5 microns diameter and 2 mole % to 25 mole % of an oxide additive selected from the group consisting of $Bi_2O_3$, $Co_3O_4$, CoO, MnO, $MnO_2$, $Cr_2O_3$, $Sb_2O_3$ and mixtures thereof, having an average particle size of between about 0.01 micron to about 1.5 microns diameter, with (2) an aqueous binder solution comprising: an organic water soluble binder that will decompose at temperatures between about 150° to about 600° C leaving no carbon residue, wherein the weight ratio of oxide:binder is between about 100:1 to about 100:10, and an organic lubricating wax that will decompose at temperatures between about 150° to about 600° C, wherein the weight ratio of mixed oxide:lubricant is between about 100:0.1 to about 100:4 to provide a slurry, and then (B) spray drying the slurry to form larger spherical agglomerated particles, having an average particle size of between about 0.5 micron to about 500 microns diameter, with 50 wt.% to 80 wt.% of the agglomerated powder masses having an average particle size of between about 25 microns and about 500 microns, and 20 wt.% to 50 wt.% of the agglomerated powder masses having an average particle size of between about 0.5 micron and about 2.5 microns, essentially each of said agglomerated particles containing the oxides and binder, and then (C) pressing a mass of the agglomerated particles in a uni-axial press, at between about 72 kg./sq. cm. to about 240 kg./sq. cm., to provide a pressed body having a substantially uniform density, and then (D) heating the pressed body at a temperature:

(1) between 25° to about 600° C, at a temperature rate increase of between about 10° C/hr. to about 45° C/hr., to slowly decompose and remove the binder, and then (2) between about 625° to about 1,400° C, at a temperature rate increase of between about 75° C/hr. to about 150° C/hr., for a time effective to sinter together the particles of the pressed body, to form a homogeneous body having a substantially uniform density, which can exhibit non-linear V-I characteristics.

8. The method of claim 7 wherein the density of the pressed body and sintered pressed body will vary no more than about 10% between the pressed ends of the pressed body and the sintered pressed body, the binder is polyvinyl alcohol, the slurry has a viscosity between about 50 cp. to about 3,000 cp. and the pressed body has minimum dimensions of 5 cm. diameter and 0.64 cm. thickness.

9. The method of claim 7 where electrodes are applied to opposite surfaces of the sintered body and the binder is polyvinyl alcohol.

* * * * *